US008047889B2

(12) United States Patent
Ishii

(10) Patent No.: US 8,047,889 B2
(45) Date of Patent: Nov. 1, 2011

(54) BLOCK SET AND MANAGING METHOD THEREOF

(75) Inventor: Masato Ishii, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 1116 days.

(21) Appl. No.: 11/641,824

(22) Filed: Dec. 20, 2006

(65) Prior Publication Data

US 2007/0163010 A1 Jul. 12, 2007

(30) Foreign Application Priority Data

Dec. 22, 2005 (JP) ..... 2005-370271

(51) Int. Cl.
*A63H 33/04* (2006.01)

(52) U.S. Cl. ..... 446/85; 446/91

(58) Field of Classification Search ..... 446/1
See application file for complete search history.

(56) References Cited

U.S. PATENT DOCUMENTS

| | | | | |
|---|---|---|---|---|
| 5,661,470 | A * | 8/1997 | Karr | 340/10.33 |
| 5,779,515 | A * | 7/1998 | Chung | 446/90 |
| 5,853,327 | A * | 12/1998 | Gilboa | 463/39 |
| 6,190,174 | B1 * | 2/2001 | Lam | 434/169 |
| 6,443,796 | B1 * | 9/2002 | Shackelford | 446/91 |
| 6,952,196 | B2 * | 10/2005 | Weil et al. | 345/156 |
| 6,965,298 | B2 * | 11/2005 | Feinberg | 340/10.41 |
| 7,596,473 | B2 * | 9/2009 | Hansen et al. | 703/1 |
| 2002/0196250 | A1 * | 12/2002 | Anderson et al. | 345/420 |
| 2003/0148249 | A1 * | 8/2003 | Marcus et al. | 434/156 |
| 2004/0164302 | A1 | 8/2004 | Arai et al. | |
| 2005/0026537 | A1 * | 2/2005 | Hsieh et al. | 446/330 |
| 2006/0238312 | A1 | 10/2006 | Ishii | |
| 2007/0262984 | A1 * | 11/2007 | Pruss | 345/420 |

FOREIGN PATENT DOCUMENTS

| | | |
|---|---|---|
| JP | 06-049350 | 4/1992 |
| JP | 2000-288260 | 10/2000 |
| JP | 2002-215012 | 7/2002 |

* cited by examiner

*Primary Examiner* — Melba Bumgarner
*Assistant Examiner* — Tramar Harper
(74) *Attorney, Agent, or Firm* — Nixon Peabody LLP; Jeffrey L. Costellia

(57) ABSTRACT

A block set is provided, which comprises at least two blocks, and a container box for storing the two blocks. Each of the two blocks includes a wireless chip. The wireless chip has a memory which stores an identification number. The container box includes a reader for obtaining information of the wireless chip, an interface portion for communicating with a server via the Internet the information of the wireless chip and for receiving a manual from the server via the Internet, a memory for storing the manual, and a display portion for displaying the manual.

15 Claims, 11 Drawing Sheets

| ID number | shape | color |
|---|---|---|
| 700 | shape 1 | color 1 |
| 701 | shape 2 | color 2 |
| 702 | shape 3 | color 3 |
| ⋮ | ⋮ | ⋮ |

FIG. 3

BLOCK SET AND MANAGING METHOD THEREOF

BACKGROUND OF THE INVENTION

1. Field of the Invention

The present invention relates to a toy block set including a block with which wireless communication is possible, and a managing method thereof.

2. Description of the Related Art

In recent years, intellectual education of young children has attracted a great deal of interest, and various educational toys thought to stimulate brain development of young children have been developed and sold. In particular, toy blocks (hereinafter referred to as blocks) and building blocks are considered to be beneficial in developing spatial reasoning ability and creative ability. In addition, it is thought that brain development is stimulated by young children moving their hands.

Many blocks with a purpose of intellectual education of young children, such as the foregoing, exist (for examples, refer to Patent Document 1: Japanese Published Patent Application No. 2000-288260, and Patent Document 2: Examined Utility Model Application Publication No. H6-49350).

Also, blocks including a block on which a character component of a Kanji character is displayed, where the block has an RFID tag attached to it that stores a discrimination code for determining the character component of the Kanji character, are suggested as a learning-support system (refer to Patent Document 3: Japanese Published Patent Application No. 2002-215012).

SUMMARY OF THE INVENTION

It is thought that young children develop their spatial reasoning abilities and creative abilities by mimicking a shape of something, and young children build blocks by actually seeing something that is built (for example, an automobile, a train, an airplane, or the like) or by looking at an assembly manual that comes with purchasing a block set that is a group of a plurality of blocks.

An assembly manual that is included in an existing block set is printed on paper, and the assembly manual is not easily revised even if a new assembly manual is created at a developer of the block set.

Further, in a case of additionally purchasing a block set in accordance with a development of a young child, blocks of a block set purchased before cannot be used for building with an assembly manual of the additionally purchased block set.

Consequently, an object of the present invention is to make easy a change in an assembly manual, and to provide blocks with which further stimulation in the development of young children can be expected, and a managing method thereof.

In view of the foregoing problem, according to the present invention, a wireless chip is embedded in a block, and by providing a container box having a function of storing many blocks each embedded with the wireless chip; a function of obtaining information in the wireless chip that is storing the information; a function of sending the information obtained via the Internet; and a function of displaying information received via the Internet, the blocks can be efficiently managed, and an assembly manual can be easily revised.

One feature of the present invention is a toy block set including blocks each including a wireless chip and a container box of the blocks. The container box has a function of storing the blocks; a function of obtaining information of the wireless chips; a function of communicating the obtained information via the Internet; and a display portion for displaying information received via the Internet.

According to the present invention of the foregoing structure, the wireless chip is preferably attached to the block.

According to the present invention of the foregoing structure, the wireless chip preferably includes a thin film transistor formed over an insulating substrate.

According to the present invention of the foregoing structure, the insulating substrate is preferably a film substrate.

Another feature of the present invention is a managing method of a wireless chip embedded in a block and a toy block set including a container box. The wireless chip includes a resonance circuit, a power generation circuit, a clock generation circuit, a demodulation circuit, a reading circuit, an authentication register, an encoding circuit, and a modulation circuit. The block is managed by the managing method of the toy block set in the following manner: the resonance circuit generates an AC signal from electrical waves received from the container box; the power generation circuit generates power from the AC signal; the clock generation circuit generates a clock signal from the AC signal; the demodulation circuit demodulates the AC signal and transmits the demodulated data to the reading circuit; the reading circuit transmits an authentication number reading instruction included in the demodulated data to the authentication register; the authentication register transmits to the encoding circuit an authentication number unique to the wireless chip according to the authentication number reading instruction; the encoding circuit transmits to the modulation circuit an authentication signal, which is the authentication number that is encoded; and the modulation circuit transmits modulated data to the resonance circuit, which is the authentication signal that is modulated.

According to the present invention of the foregoing structure, the container box includes a container portion of blocks, a display portion for displaying an assembly manual of the blocks, and a control apparatus for controlling the container box. Further, the control apparatus preferably includes a reader portion that can transmit/receive the authentication signal to/from the wireless chip.

According to the present invention of the foregoing structure, it is preferable that by the control apparatus, an assembly manual is received via the Internet and revised.

Note that according to the present invention, a semiconductor device refers to a device including a semiconductor element.

One feature of the present invention is a block set (also referred to as a toy block set), which comprises at least two blocks, and a container box for storing the two blocks. Each of the two blocks includes a wireless chip. The wireless chip has a memory (also referred to as an authentication register) which stores an identification number. The container box includes a reader for obtaining information of the wireless chip, an interface portion for communicating with a server via the Internet the information of the wireless chip and for receiving a manual from the server via the Internet, a memory for storing the manual, and a display portion for displaying the manual.

One feature of the present invention is a managing method of a block set (also referred to as a toy block set) including at least two blocks and a container box, comprising the steps of: obtaining information of a wireless chip of the block by a reader portion of the container box, communicating the information of the wireless chip and receiving a manual via the Internet by an interface portion of the container box, storing the manual in the memory of the control apparatus, and displaying the manual by a display portion of the container box.

One feature of the present invention is a managing method of a block set (also referred to as a toy block set) including a wireless chip and a container box, comprising the steps of: obtaining information of a wireless chip of the block by a reader portion of the container box, communicating the information of the wireless chip and receiving a first manual via the Internet by an interface portion of the container box, storing the first manual in the memory of the control apparatus, displaying the first manual by a display portion of the container box, receiving a second manual via the Internet by the control apparatus, storing the second manual in the memory of the control apparatus, and displaying the second manual by the display portion.

Note that according to the present invention, a wireless chip refers to a semiconductor device capable of wireless communication.

According to the present invention, by embedding a wireless chip in a block, the block can be efficiently managed, and an assembly manual can easily be revised to one that is more advanced in accordance with a development of a young child; therefore, stimulation of brain development of the young child can be expected.

BRIEF DESCRIPTION OF DRAWINGS

In the accompanying drawings:

FIG. 3 shows a management table of authentication information;

DETAILED DESCRIPTION OF THE INVENTION

Figure 1:
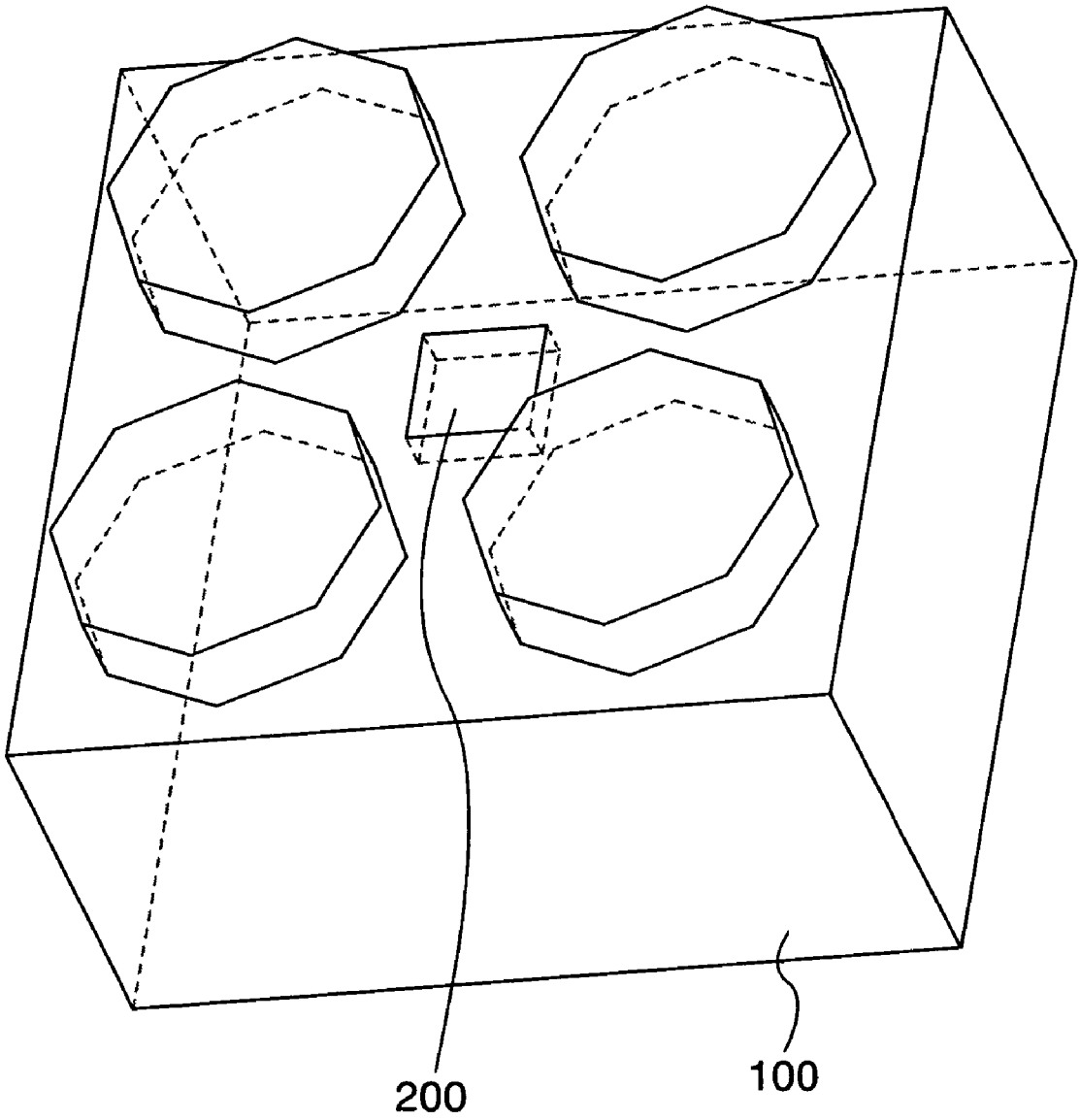
FIG. 1 shows a block of the present invention.

Embodiment modes of the present invention will hereinafter be described based on the accompanying drawings. However, the present invention can be carried out in many different modes, and it is easily understood by those skilled in the art that modes and details herein disclosed can be modified in various ways without departing from the spirit and the scope of the present invention. Therefore, the present invention should not be interpreted as being limited to the description of the embodiment modes to be given below. Note that in all drawings for describing the embodiment modes, the same reference numerals are used for the same portions or the portions having similar functions, and the repeated description thereof is omitted.

Embodiment Mode 1

In this embodiment mode, a structural example of a block of the present invention embedded with a wireless chip, and a structural example of the embedded wireless chip are described. Further, a structural example of a container box for managing blocks and taking in an assembly manual, as well as a method of taking in the assembly manual are described in this embodiment mode.

A structure of a block of this embodiment mode embedded with a wireless chip is described with reference to FIG. 1. A block 100 includes a wireless chip 200. After completion of the block 100, the wireless chip 200 may be built into the block 100 by removing a portion of the block 100 and attaching the wireless chip 200, implanting the wireless chip 200, or the like. Also, the wireless chip 200 may be built into the block 100 during a manufacturing process of the block 100, so that the wireless chip 200 is embedded in the block 100. It is to be noted that FIG. 1 shows the block 100 implanting the wireless chip 200.

Note that although FIG. 1 shows a white, rectangular block 100 embedded with a wireless chip 200. However, a variety of shapes and colors can be considered for a block embedded with a wireless chip. The block of the present invention is not limited to a specific shape or color.

Figure 2:
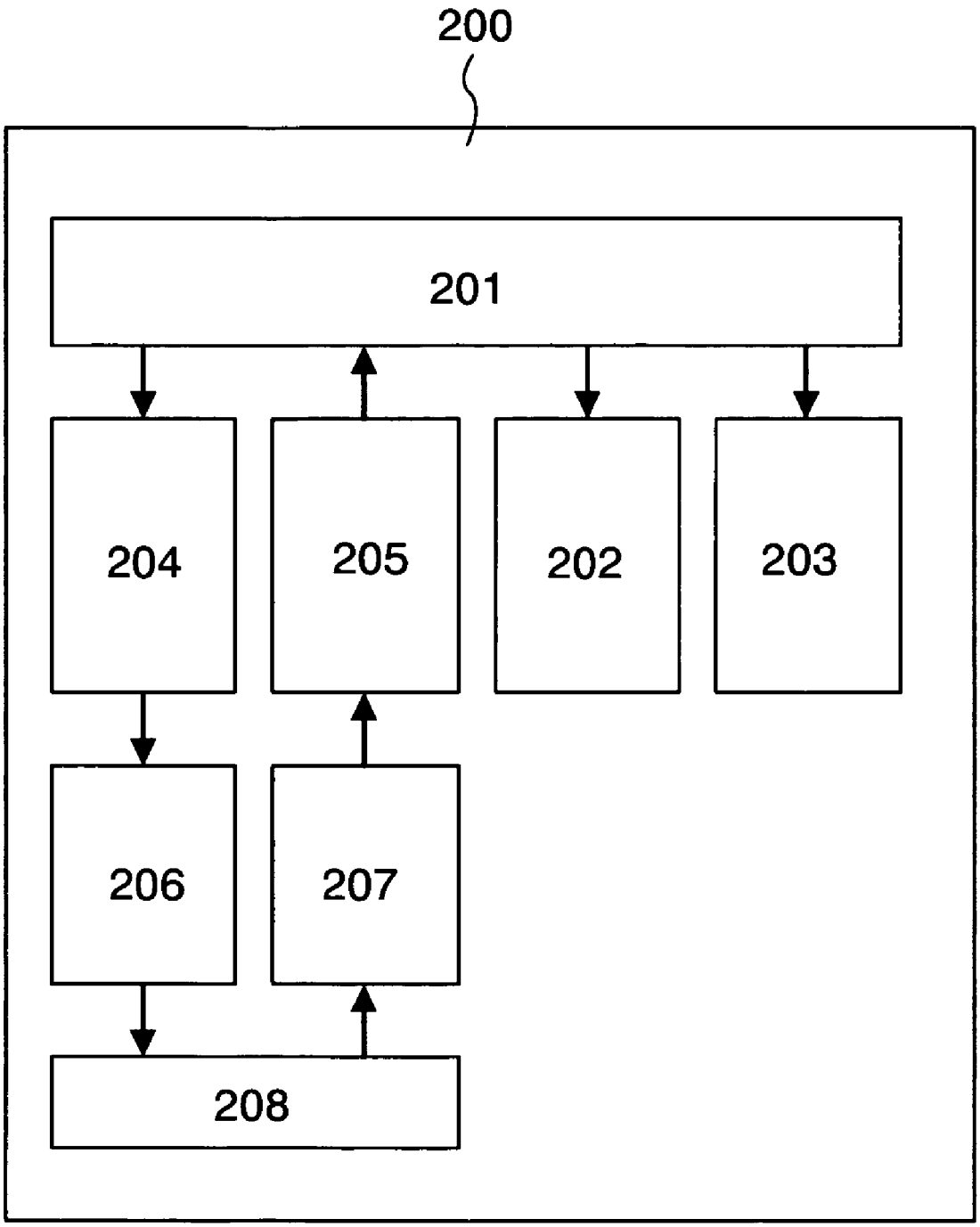
FIG. 2 shows a structure of a wireless chip of a block of the present invention.

Next, a structure of the wireless chip of this embodiment mode is described with reference to FIG. 2. The wireless chip 200. includes a resonance circuit 201 including an antenna and a resonant capacitor; a power generation circuit 202; a clock generation circuit 203; a demodulation circuit 204; a modulation circuit 205; a reading circuit 206; an encoding circuit 207; and an authentication register 208. The authentication register is also called an ID register.

The resonance circuit 201 is a circuit that can receive electrical waves from a container box 300 and generate an AC signal at one end of the antenna and another end opposite thereto. The generated AC signal includes information from the container box 300. Further, the AC signal could become an electrical power source of the wireless chip 200. Furthermore, the resonance circuit 201 is a circuit that can transmit modulated data by electrical waves to the container box 300 via the antenna.

The power generation circuit 202 is a circuit that can generate power by rectifying an AC signal that is generated in the resonance circuit 201 in a rectifying circuit (includes a diode) and smoothing the AC signal using a capacitor, as well as supply the power to each circuit. It is to be noted that the power generation circuit 202 includes the rectifying circuit.

The clock generation circuit 203 is a circuit that can generate a clock signal from an AC signal generated in the resonance circuit 201, and supply the clock signals to each circuit.

The demodulation circuit 204 is a circuit that can demodulate the AC signal generated in the resonance circuit 201, and send the demodulated data to the reading circuit 206.

The reading circuit 206 is a circuit that can extract reading instruction information from the demodulated data that has been sent, and give an authentication number reading instruction to the authentication register 208.

The authentication register 208 includes a memory in which an authentication number unique to each wireless chip is built into during manufacturing of wireless chips, and is a circuit that can send the authentication number to the encoding circuit 207 when the authentication reading instruction is received from the reading circuit 206. As the memory, an SRAM, a flash memory, a non-volatile memory, a ROM, a FeROM, or the like, or an organic memory in which an organic material is sandwiched between a pair of electrodes, or the like can be applied. It is to be noted that the present invention is not limited to the memory in which an authentication number of a wireless chip is built into.

Note that all authentication information of this embodiment mode are managed at a block developer, and the block developer makes it so that a wireless chip, which has a unique authentication number, corresponds to a shape and a color of a block including the wireless chip. Here, an example of a managing method is described with reference to FIG. 3. FIG. 3 shows a table for managing authentication information, and authentication number 700 corresponds to shape 1 and color 1 of a block, authentication number 701 corresponds to shape 2 and color 2 of a block, and so on to manage authentication information.

Note that authentication information includes an authentication number, information about a shape of a block, and information about a color of the block. In this embodiment mode, a wireless chip has a memory for storing an authentication number. However, the present invention is not limited to this. The wireless chip might have a memory for storing authentication information.

The encoding circuit 207 is a circuit that can generate a signal that is an encoded authentication number when an authentication number is sent from the authentication register 208, and output the encoded signal to the modulation circuit 205.

The modulation circuit 205 is a circuit that can modulate the encoded signal, and output the modulated data to the resonance circuit 201.

Figure 4:
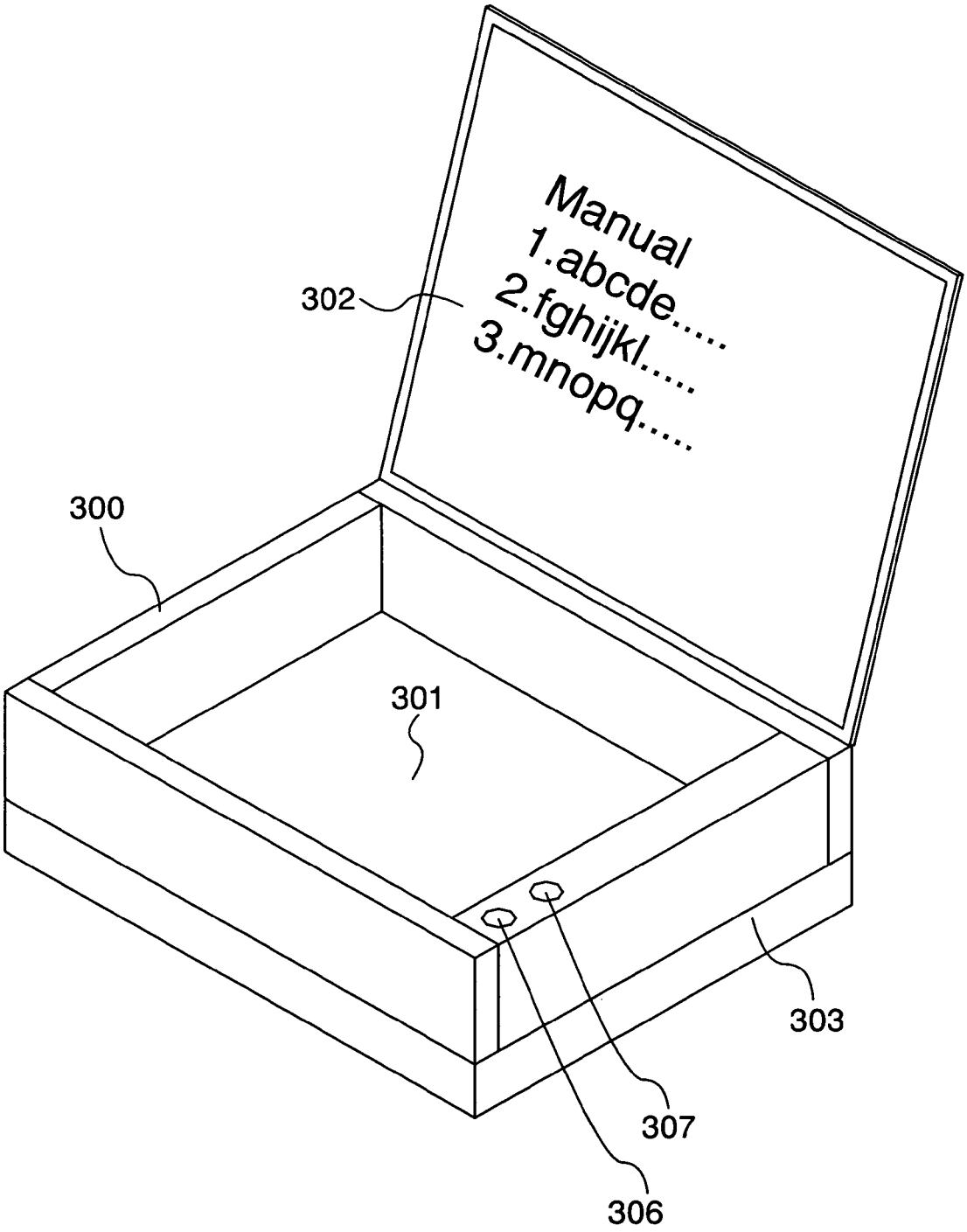
FIG. 4 shows a container box of the present invention.

Next, a structure of a container box of this embodiment mode is described with reference to FIG. 4. The container box 300 includes a container portion 301 having a large enough volume for storing a large number of blocks, a display portion 302 for displaying an assembly manual for a structural object to be formed using the blocks stored in the container box, a control apparatus 303 for controlling the container box 300, an ID acquisition button 306, and a transmission button 307.

Figure 5:
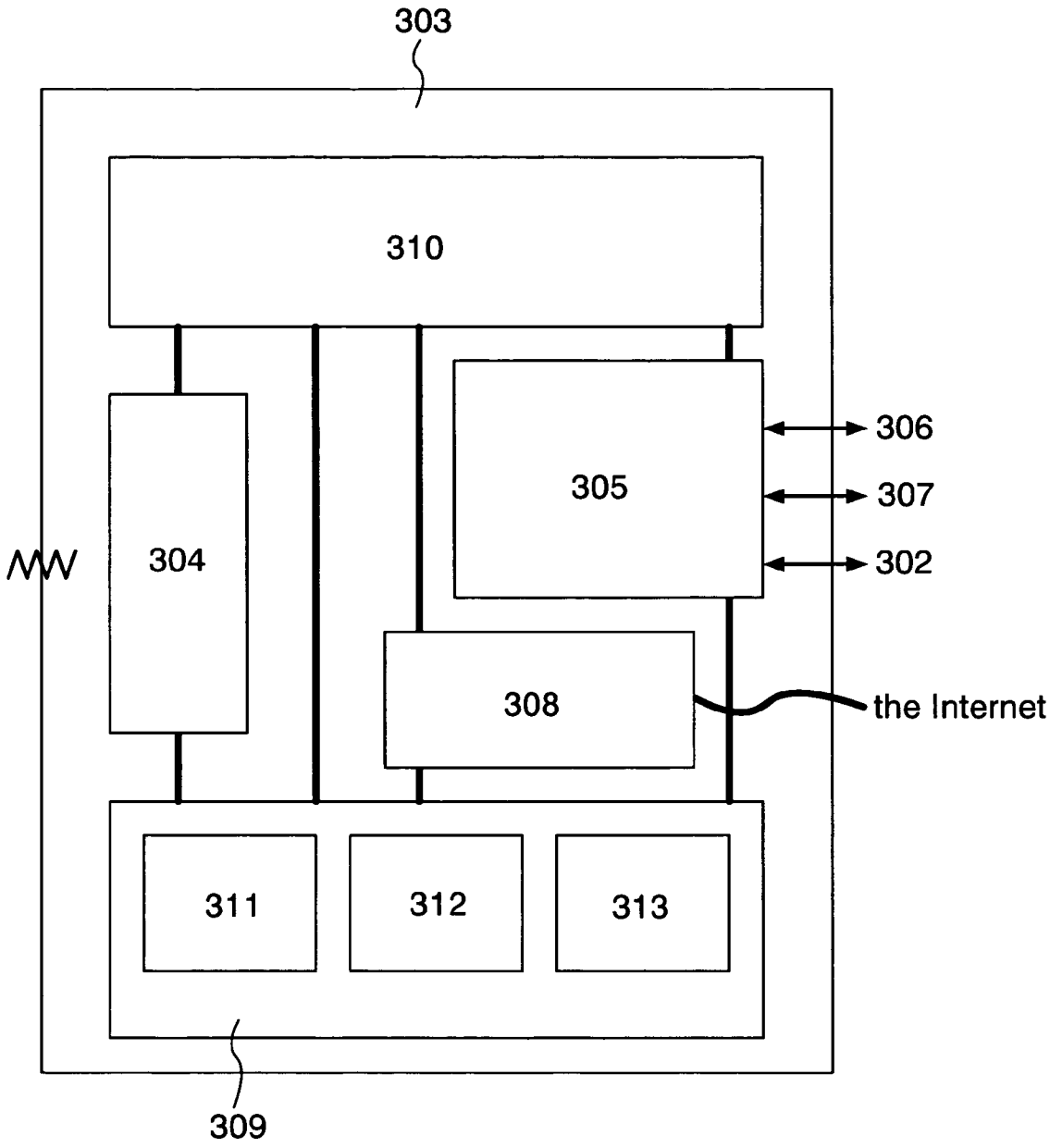
FIG. 5 shows a control apparatus of a container box of the present invention.

Subsequently, a structure of the control apparatus 303 of this embodiment mode is described with reference to FIG. 5. The control apparatus 303 includes a reader portion 304, an input/output interface portion 305, a network interface portion 308, a memory portion 309, and a main body control portion 310.

A function of each portion included in the control apparatus 303 is descried below.

The memory portion 309 includes a program storage region 311 for storing a program that is executed by the main body control portion 310, an authentication number storage region 312 for storing an authentication number of a wireless chip of each block; and an assembly manual storage region 313 for storing data of an assembly manual. As the memory portion 309, an SRAM, a flash memory, a non-volatile memory, a ROM, a FeROM, or the like, or an organic memory in which an organic material is sandwiched between a pair of electrodes, or the like can be applied. In particular, it is preferable to apply a non-volatile memory with which stored data is not lost even if a power source is not supplied.

It is to be noted that the authentication number storage region 312 can be stored authentication information which includes an authentication number, information about shape of a block, and information about color of the block.

The reader portion 304 has a function of transmitting electrical waves according to an instruction from the main body control portion 310, in order to obtain an authentication number of a wireless chip of each block that is stored in the container box 300. The reader portion 304 also has a function of receiving an authentication number of a wireless chip transmitted from each block and storing the authentication number in the authentication number storage region 312 of the memory portion 309.

The reader portion 304 includes a resonance circuit 201 including an antenna and a resonant capacitor. The resonance circuit 201 receives electrical waves from the wireless chip 200.

The input/output interface portion 305 has a function of accepting a pressing down of the ID acquisition button and the transmission button as signals, and notifying the main body control portion 310. The input/output interface portion 305 also has a function of displaying on the display portion 302 data of an assembly manual stored in the assembly manual storage region 313 of the memory portion 309, according to an instruction from the main body control portion 310.

The network interface portion 308 has a function of transmitting an authentication number of a wireless chip of each block stored in the authentication number storage region 312 of the memory portion 309, to a server of a block developer through the Internet, according to an instruction from the main body control portion 310. The network interface portion 308 also has a function of storing data of a new assembly manual that is transmitted from the server of the developer in the assembly manual storage region 313 of the memory portion 309.

The main body control portion 310 has a function of reading a program from the program storage region 311 of the memory portion 309, and giving instruction to each portion.

Next, a method of taking in an assembly manual is described. Note that taking in of an assembly manual described below is carried out by the main body control portion 310 executing the program stored in the program storage region 311 of the memory portion 309.

Figure 6:
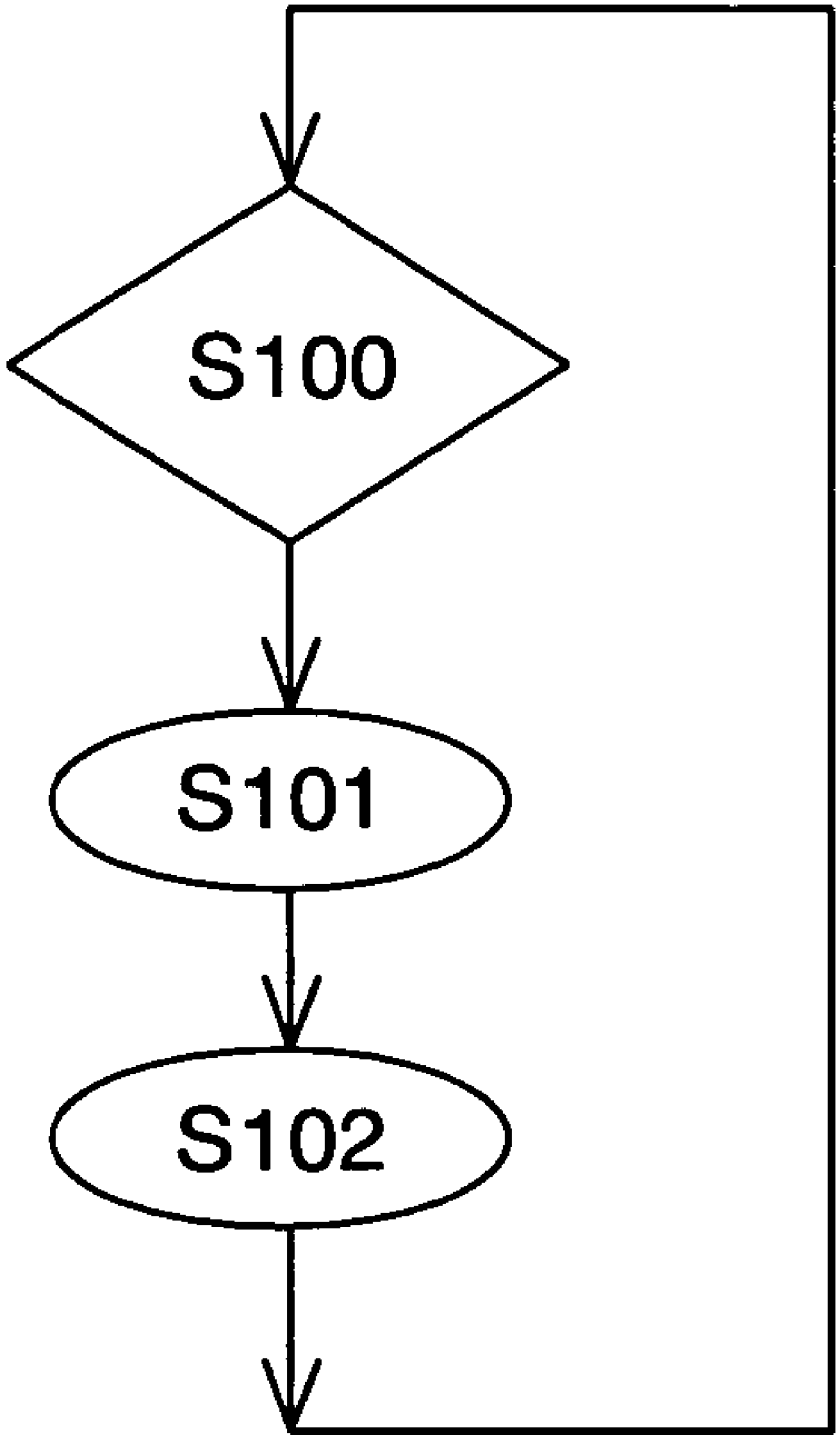
FIG. 6 shows a flow chart of the present invention.

First, a series of operation in this embodiment mode of a wireless chip, with which the container box 300 obtains an authentication number of a wireless chip necessary for management of a block, is described with reference to FIG. 6.

A "standby" state of S100 indicates a state in which the wireless chip 200 is waiting for electrical waves from the reader portion 304 of the container box 300, and performs no operation. If electrical waves are not received from the reader portion 304, the "standby" state is maintained. If electrical waves are received from the reader portion 304, the state transitions to an "electrical wave reception" state of S101.

The "electrical wave reception" state of S101 indicates a state in which the wireless chip 200 receives electrical waves from the reader portion 304, the resonance circuit 201 generates an AC signal based on the received electrical waves, the power generation circuit 202 generates power to be consumed in each circuit based on the generated AC signal and supplies the generated power to each circuit, the clock generation circuit 203 generates a clock signal for synchronous operation of the circuits based on the generated AC signal and supplies the generated clock signal the each circuit, the demodulation circuit 204 demodulates the AC signal generated in the resonance circuit 201 to generate demodulated data, and the reading circuit 206 extracts reading instruction information from the demodulated data and sends the extracted authentication information reading instruction to the authentication register 208. Subsequently, the state transitions to an "electrical wave transmission" state of S102.

The "electrical wave transmission" state of S102 indicates a state in which the authentication register 208 sends an authentication number of a wireless chip to the encoding circuit 207 after the authentication register 208 of the wireless chip 200 receives an authentication information reading instruction, the encoding circuit 207 generates a signal which is the authentication number that is encoded, the modulation circuit 205 modulates the encoded signal, and the resonance circuit 201 transmits data that is modulated from electrical waves to a reader via an antenna. Next, the state returns to the "standby" state of S100, to wait for subsequent electrical waves.

By the foregoing, the reader portion 304 of the container box 300 can receive an authentication number of a wireless chip of each block, and the container box 300 can obtain the authentication number of a wireless chip of each block.

Figure 7:
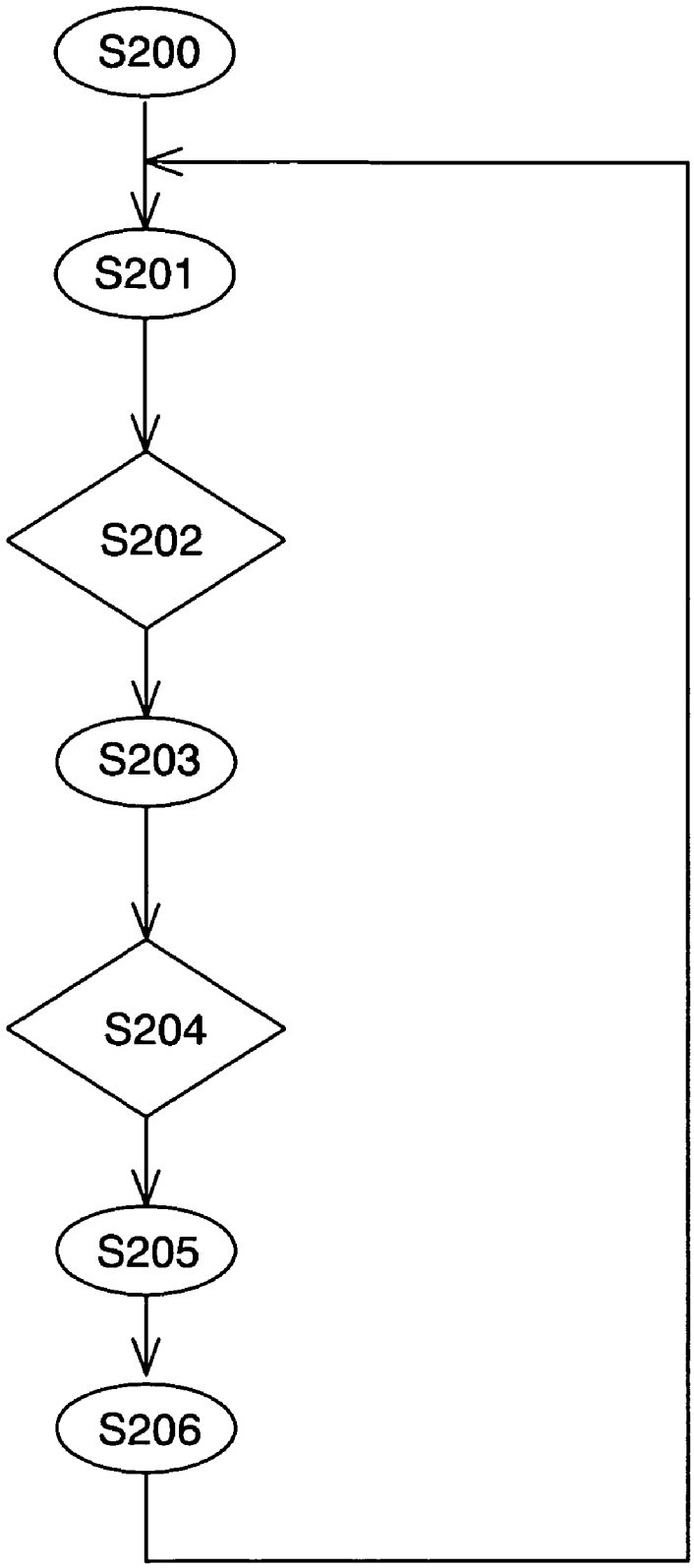
FIG. 7 shows a flow chart of the present invention.

Hereinafter, a method in this embodiment mode of taking an assembly manual into the container box 300 first, in a case where an assembly manual is not stored in the container box 300 is described with reference to FIG. 7.

A "start-up" state of S200 indicates a state in which a power source is supplied to the container box 300, and execution of a program stored in the program storage region 311 of the memory portion 309 by the main body control portion 310 has begun. Subsequently, the "start-up" state transitions to a "display" state of S201.

The "display" state of S201 is a state in which a sentence is displayed on the display portion 302 saying that there is no assembly manual, when a "display" state is reached for the first time in a case where no assembly manual is stored in the container box 300. The "display" state subsequently transitions to a "standby" state of S202.

The "standby" state of S202 indicates a state in which the container box 300 waits for the ID acquisition button to be pressed down. Note that what is displayed on the display portion 302 does not change from what is displayed in S201. If the ID acquisition button is not pressed down, the "standby" sate is maintained. If the ID acquisition button is pressed down, the state transitions to an "ID acquisition" state of S203.

The "ID acquisition" state of S203 indicates a state in which an authentication number of a wireless chip of each block stored in the container box is obtained by the reader portion 304, and the authentication number is stored in the authentication number storage region 314 of the memory portion 309. When storing is finished, the state transitions to a "transmission waiting" state of S204.

The "transmission waiting" state of S204 indicates a state in which an authentication number of a wireless chip of each block is displayed on the display portion 302 as well as a sentence saying that the authentication numbers of the blocks will be sent to a server of a developer, and that the transmission button is waiting to be pressed down. If the transmission button is not pressed down, the "transmission waiting" state is maintained. If the transmission button is pressed down, the state transitions to a "transmission" state of S205.

The "transmission" state of S205 indicates a state in which the authentication numbers are being transmitted via the network interface portion 308 to the server of the developer through the Internet. When transmission is complete, the state transitions to a "reception" state of S206.

The "reception" state of S206 indicates a state in which the control apparatus 303 is receiving data of an assembly manual from the server of the developer through the Internet, and the received data is being stored in the assembly manual storage region 313 of the memory portion 309. When storing is complete, the state transitions to the "display" state of S201, and the assembly manual that has been taken in is displayed.

Note that after taking in an assembly manual first, a power source is supplied to the container box, and when the "display" state of S201 is reached, an assembly manual is displayed on the display portion 302 based on data of the assembly manual initially taken in, which is stored in the assembly manual storage region 313 of the memory portion 309.

Also, in a case of taking in data of a new assembly manual, data of an assembly manual that is newly taken in is stored in the assembly manual storage region 313 of the memory portion 309 by overwriting. Consequently, in a case where a power source is supplied to the container box, a newly revised assembly manual is always displayed on the display portion.

Note that it is not necessary to store a new assembly manual in the assembly manual storage region 313 by overwriting. The assembly manual that is newly taken and the manual that is taken before can be stored in the assembly manual storage region 313.

In this embodiment mode, revision of an assembly manual is carried out in the above manner.

In a case where a block embedded with a wireless chip is added, by storing the added block together with existing blocks in the container box, and by taking in a new assembly manual by the method of taking in an assembly manual as described above, an assembly manual can be revised to one that uses the existing blocks and the added block.

In this embodiment mode, a mode in which an assembly manual is taken in at the beginning is described; however, it may be that data of an assembly manual is already stored from the time of pickup from a factory.

According to this embodiment mode, by embedding a wireless chip in a block, the block can be managed efficiently and an assembly manual can be revised easily.

Embodiment Mode 2

In this embodiment mode, a manufacturing method of a wireless chip that is attached to a block is described.

Figure 8A:
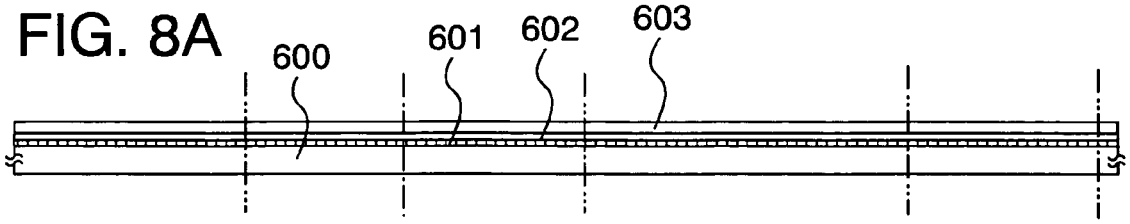
FIGS. 8A to 8D each show a formation method of a wireless chip of a block of the present invention.

In FIG. 8A, a peeling layer 601, an insulating layer 602, and a semiconductor film 603 are formed in this order over a substrate having an insulating surface (insulating substrate 600). As the insulating substrate 600, a glass substrate, a quartz substrate, a substrate formed of silicon, a metal substrate, a plastic substrate, or the like can be used. The insulating substrate 600 may be thinned by polishing. By using a thinned insulating substrate, a final product can be reduced in weight and in thickness.

The peeling layer 601 can be formed of an element selected from W, Ti, Ta, Mo, Nb, Nd, Ni, Co, Zr, Zn, Ru, Rh, Pd, Os, Ir, and Si; or an alloy material or a compound material mainly containing the element. The peeling layer can have a single layer structure of the element or the like, or a stacked layer structure of the element and the like. Such a peeling layer can be formed by a CVD method, a sputtering method, an electron beam, or the like. In this embodiment mode, W is formed by a CVD method. At that time, a plasma treatment may be carried out using $O_2$, $N_2$, or $N_2O$. Then, a peeling step which is a later step can be carried out simply. The peeling layer 601 can have a single layer structure or a stacked layer structure. The peeling layer 601 is not necessary to be formed over the whole insulating substrate, and may be formed selectively. That is, it is acceptable as long as the peeling layer 601 allows the insulating substrate 600 to peel off later, and a region in which the peeling layer is formed is not limited.

For the insulating layer 602, an inorganic material such as silicon oxide, silicon nitride, or the like can be used. The insulating layer 602 can have a single layer structure or a stacked layer structure. By using silicon nitride, entrance of an impurity element from the insulating substrate can be prevented. When the insulating layer 602 has a stacked layer structure, such silicon nitride is effective by being included in one layer.

A material including silicon can be used for the semiconductor film 603. The semiconductor film can be formed using a CVD method or a sputtering method. A crystal structure of the semiconductor film 603 may be any of amorphous, crystalline, and microcrystalline. The higher the crystallinity, the higher a mobility of a thin film transistor can be made, which is preferable. Also, with a microcrystalline or amorphous crystalline structure, there is no variance in crystal state between adjacent semiconductor films, which is preferable.

In forming a crystalline semiconductor film, there is a case where the crystalline semiconductor film is directly formed over the insulating layer 602; however, it is manufactured by heating an amorphous semiconductor film formed over the insulating layer 602. For example, the amorphous semiconductor film is heated using a heating furnace or by laser irradiation. As a result, a semiconductor film with high crystallinity can be formed. At this time, in order to lower a heating temperature, a metal element which promotes crystallization may be used. For example, by adding nickel (Ni) to a surface of the amorphous semiconductor film and carrying out a heating treatment, the temperature can be lowered. As a result, a crystalline semiconductor film can be formed over an insulating substrate having low heat resistance. Note that in a case of using laser irradiation, since a semiconductor film is heated selectively, heating temperature is not restricted by heat resistance of an insulating substrate that is used.

Figure 8B:
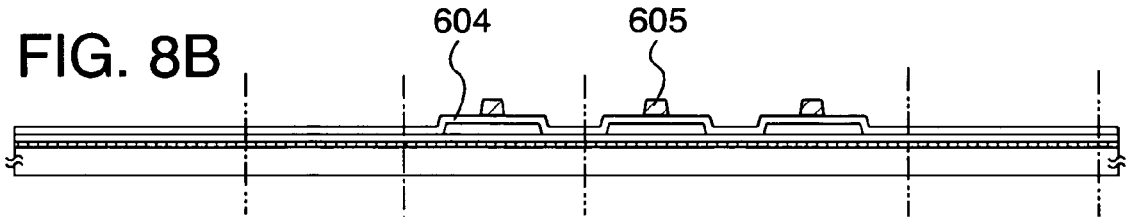

As shown in FIG. 8B, the semiconductor film 603 is processed so as to have a prescribed shape. For the process, etching using a mask formed by a photolithography method can be used. A dry etching method or a wet etching method can be used for the etching.

An insulating layer functioning as a gate insulating film 604 is formed so as to cover the processed semiconductor film. The gate insulating film 604 can be formed using an inorganic material; for example, it can be formed using silicon nitride or silicon oxide. A plasma treatment may be carried out before or after forming the gate insulating film 604. For the plasma treatment, oxygen plasma or hydrogen plasma can be used. By such a plasma treatment, an impurity can be removed from a gate insulating film formation surface or a gate insulating film surface.

Subsequently, a conductive layer functioning as a gate electrode 605 is formed over the semiconductor film with the gate insulating film 604 interposed therebetween. The gate electrode 605 can have a single layer structure or a stacked layer structure. For the gate electrode 605, an element selected from titanium (Ti), tungsten (W), tantalum (Ta), molybdenum (Mo), neodymium (Nd), cobalt (Co), zirconium (Zr), zinc (Zn), ruthenium (Ru), rhodium (Rh), palladium (Pd), osmium (Os), iridium (Ir), platinum (Pt), aluminum (Al), gold (Au), silver (Ag), copper (Cu), and indium (In); or an alloy material or a compound material mainly containing the element can be used.

Figure 8C:
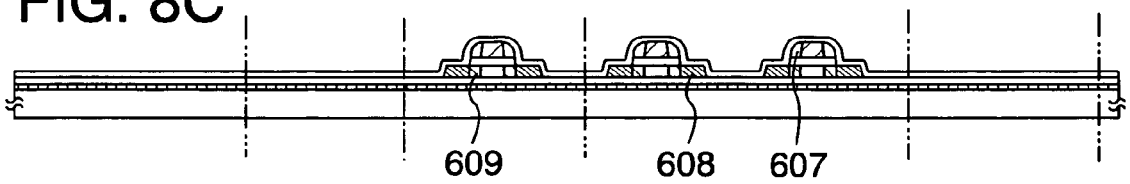

As shown in FIG. 8C, an insulator functioning as a sidewall 607 is formed over a side surface of the gate electrode 605. The sidewall 607 can be formed using an inorganic material or an organic material. As the inorganic material, silicon oxide and silicon nitride are given. For example, by forming silicon oxide so as to cover the gate electrode 605 and then carrying out isotropic etching, silicon oxide remains only over the side surface of the gate electrode 605, and this can be used as the sidewall. For the isotropic etching, a dry etching method or a wet etching method can be used. When the sidewall 607 is processed, the gate insulating film 604 is also etched away. As a result, a portion of the semiconductor film is exposed.

Using the sidewall 607 and the gate electrode 605, an impurity element is added to the semiconductor film in a self-aligning manner. As a result, impurity regions having different concentrations are formed in the semiconductor film. In other words, a low concentration impurity region 609 provided under the sidewall 607, and a high concentration impurity region 608 formed in the exposed semiconductor film are formed. In this manner, by having impurity regions with different impurity concentrations, a short channel effect can be prevented.

Figure 8D:
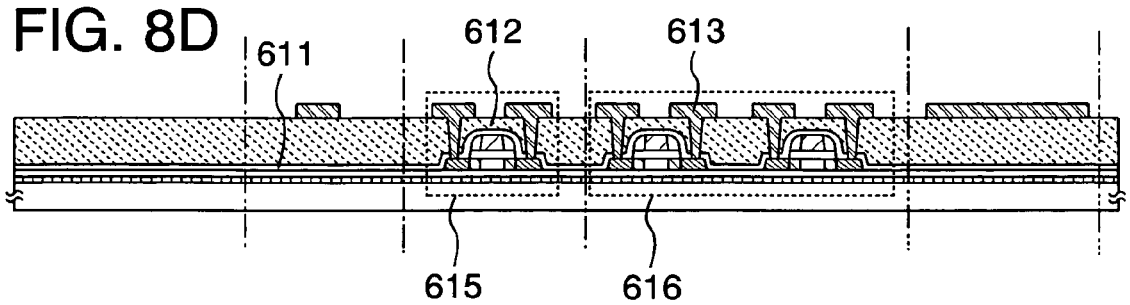

As shown in FIG. 8D, insulating layers 611 and 612 are formed covering the semiconductor film, the gate electrode, and the like. The insulating layer covering the semiconductor film, the gate electrode, and the like may have a single layer structure, but it is preferable to have a stacked layer structure as in this embodiment mode. This is because by forming the insulating layer 611 using an inorganic material, entry of an impurity can be prevented. Further, by application of the inorganic material using a CVD method, a dangling bond in the semiconductor film can be terminated using hydrogen in the insulating layer 611. Subsequently, by forming the insulating layer 612 using an organic material, flatness can be improved. As the organic material, polyimide, acrylic, polyamide, polyimide amide, a resist, or benzocyclobutene can be used. Also, siloxane or polysilazane can be used. Note that a skeletal structure of siloxane is structured by a bond of silicon (Si) and oxygen (O). For a substituent, an organic group including at least hydrogen (for example, an alkyl group or an aromatic hydrocarbon) is used. A fluoro group may be used for the substituent. Alternatively for the substituent, the organic group including at least hydrogen and the fluoro group may be used. Polysilazane is formed with a polymer material having a bond of silicon (Si) and nitrogen (N) as a starting material.

Subsequently, a wiring 613 that penetrates through the insulating layers 611 and 612 and the gate insulating film 604 and connects with the impurity region 608 is formed. The wiring 613 can have a single layer structure or a stacked layer structure, and can be formed using an element selected from titanium (Ti), tungsten (W), tantalum (Ta), molybdenum (Mo), neodymium (Nd), cobalt (Co), zirconium (Zr), zinc (Zn), ruthenium (Ru), rhodium (Rh), palladium (Pd), osmium (Os), iridium (Ir), platinum (Pt), aluminum (Al), gold (Au), silver (Ag), copper (Cu), and indium (In); or an alloy material mainly containing the element. While forming the wiring 613, another wiring can be formed over the insulating layer 612. The other wiring corresponds to a leading wiring or the like.

In this manner, a thin film transistor 615 (thin film transistor, hereinafter referred to as TFT) and a TFT group 616 can be formed. The TFT group refers to a group of TFTs forming a circuit having a specific function.

Figure 9A:
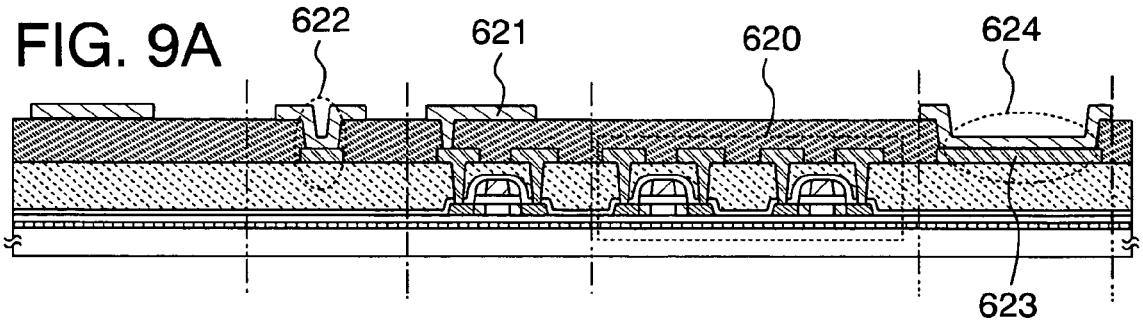
FIGS. 9A to 9C each show a formation method of a wireless chip of a block of the present invention.

As shown in FIG. 9A, an insulating layer 620 is formed over the insulating layer 612. The insulating layer 620 can be formed using an inorganic material, an organic material, or the like in a similar manner to forming the insulating layers 611 and 612. An open portion is formed in the insulating layer 620 and a wiring 621 is formed. The wiring 621 can be formed in a similar manner to forming the wiring 613. The wiring 621 is electrically connected to the wiring 613 in a region 622 via the open portion provided in the insulating layer 620. In the region 622, a common electrode of a memory element formed later can be grounded. Also, a pad 623 is formed from the same layer as the wiring 621. The pad 623 is electrically connected to the wiring 613 in a region 624 via an open portion provided in the insulating layer 620.

Figure 9B:
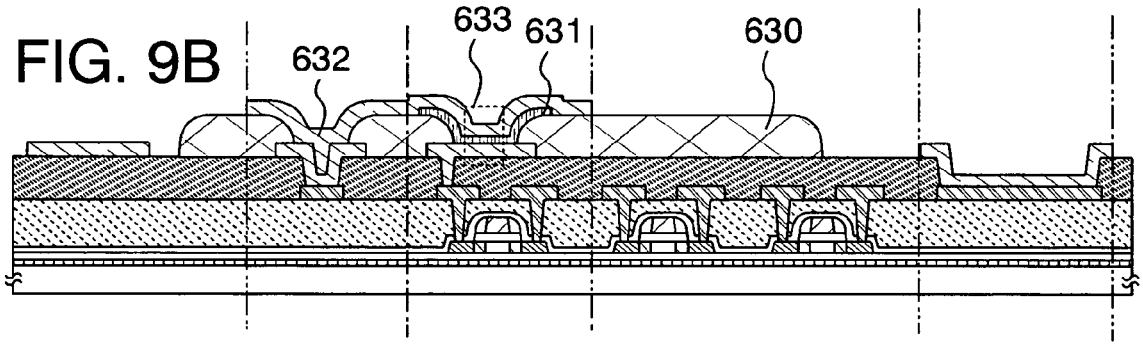

As shown in FIG. 9B, an insulating layer 630 is formed over the insulating layer 620. The insulating layer 630 can be formed using an inorganic material or an organic material in a similar manner to form the insulating layers 611 and 612.

Then, an open portion is provided in the insulating layer 630. The insulating layer 630 is processed so that a side surface of the open portion is slanted.

An organic compound layer 631 is formed in the open portion provided over the TFT 615. The organic compound layer 631 can be formed by an evaporation method or a sputtering method. Such an organic compound layer can be formed from a known electroluminescent material. Subsequently, a wiring 632 is formed covering a portion of the organic compound layer 631 and the insulating layer 630. The wiring 632 can be formed in a similar manner to the wiring 621. A region in which the wiring 632 is formed becomes a memory area and a contact region. The wiring 632 becomes a common electrode of a memory element.

Figure 9C:
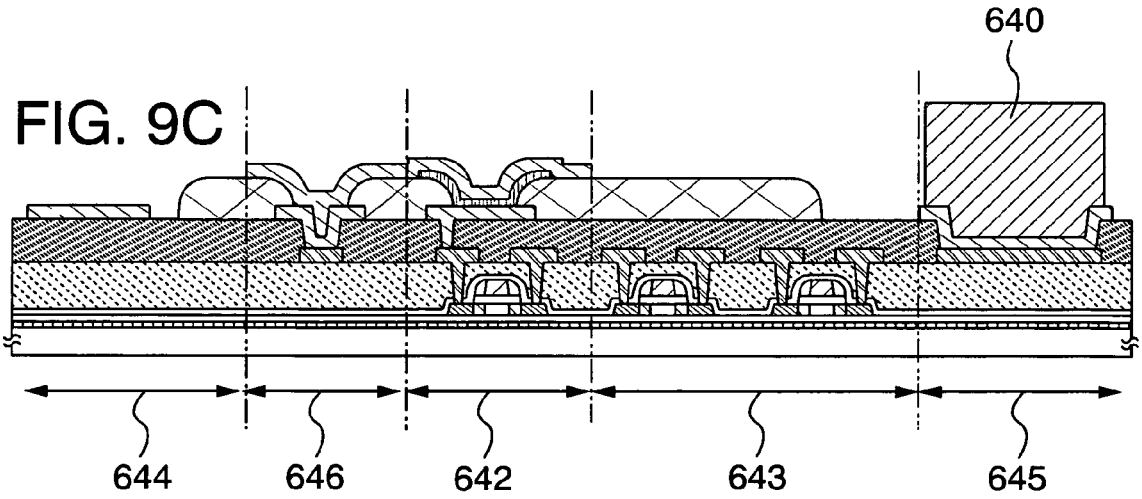

As shown in FIG. 9C, an antenna 640 is formed. At this time, the antenna 640 is thermocompressed to the pad 623 to be electrically connected. In this manner, a wireless chip including a wiring region 644 in which a leading wiring and the like are formed; a memory area 642 in which a memory element is formed; an integrated circuit region 643 including a TFT group and in which a circuit having a specific function is formed; a pad region 645; and a contact region 646. The pad region and the memory area may be provided with a certain distance therebetween. As a result, data writing can be carried out without the memory area being affected by stress when thermocompressing the antenna. Note that an integrated circuit of the integrated circuit region 643 shown here is a portion of circuits included in the wireless chip 200 described in Embodiment Mode 1 excluding the antenna of the resonance circuit 201 and the memory of the authentication register 208.

Thermocompression of the antenna may be carried out in a state where flexibility of the insulating substrate is low. Therefore, in this embodiment mode, a mode where the thin film transistor is transferred to a film substrate after thermocompression of the antenna is shown.

Figure 10A:
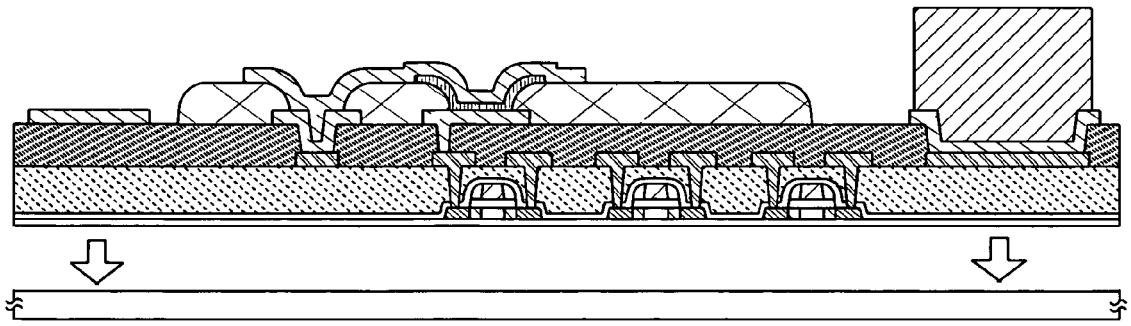
FIGS. 10A and 10B each show a formation method of a wireless chip of a block of the present invention.

As shown in FIG. 10A, by removing the peeling layer 601, the insulating substrate 600 is peeled. The peeling layer 601 can be removed physically or chemically. For example, by carrying out a heating treatment or the like on the semiconductor film, a crystal structure of the peeling layer 601 can also be changed. Subsequently, an open portion is provided so that a portion of the peeling layer 601 is exposed, and the exposed peeling layer 601 is irradiated with laser light. By irradiating the peeling layer 601 with laser light, a trigger for peeling can be provided. Then, the thin film transistor and the like can be physically peeled from the insulating substrate, and furthermore, the thin film transistor and the like may peel off naturally from the insulating substrate by stress of the film, without particularly applying force. Alternatively, the peeling layer 601 can be removed by utilizing a chemical reaction by forming an open portion reaching the peeling layer 601, and introducing an etching agent via the open portion.

Figure 10B:
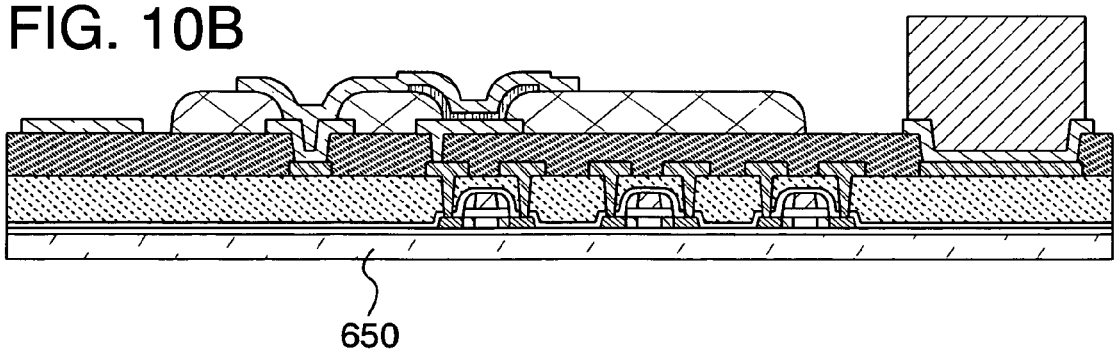

Subsequently, as shown in FIG. 10B, a film substrate 650 is attached. In a case where a surface of the film substrate 650 has an adhesive property, it can be attached as it is. In a case without an adhesive property, the film substrate 650 can be attached via an adhesive agent.

In this manner, a wireless chip in which the thin film transistor and the like are transferred to the film substrate can be formed. By such a wireless chip, reductions in weight and in thickness as well being formed over the same substrate are achieved, and attachment to a block is easy.

Further, the wireless chip may be attached to a block via an adhesive agent after removing the peeling layer 601. By doing this, reduction in the number of steps in a manufacturing process of a block embedded with the wireless chip as well as in cost can be achieved.

Embodiment Mode 3

In this embodiment mode, a manufacturing method of a wireless chip formed over a glass substrate, unlike the foregoing embodiment mode, is described.

In the foregoing embodiment mode, the manufacturing method of a wireless chip in which the peeling layer 601 is formed, and then peeled to transfer the thin film transistor to the film substrate is described. However, a wireless chip of the present invention can be directly formed over a glass substrate.

A silicon nitride film may be formed as a protective film over the uppermost layer of a wireless chip formed over a glass substrate.

Also, when reduction in thickness is desired, the glass substrate may be polished. For example, a surface of the glass substrate over which a thin film transistor is not formed is polished by a CMP method or the like. As a result, in the wireless chip, reduction in thickness of the glass substrate can be achieved, which generally has the most thickness, and thickness of the wireless chip as a whole can be reduced.

A reason that the wireless chip can be manufactured over the glass substrate in this manner is because crystallization at low temperature has become possible by using a metal element that promotes crystallization or by using laser light irradiation in a manufacturing step of a crystalline semiconductor film included in the thin film transistor, or because heating of glass can be prevented.

Embodiment Mode 4

In this embodiment mode, a structure of a wireless chip including a coil-shaped antenna is described.

Figure 11A:
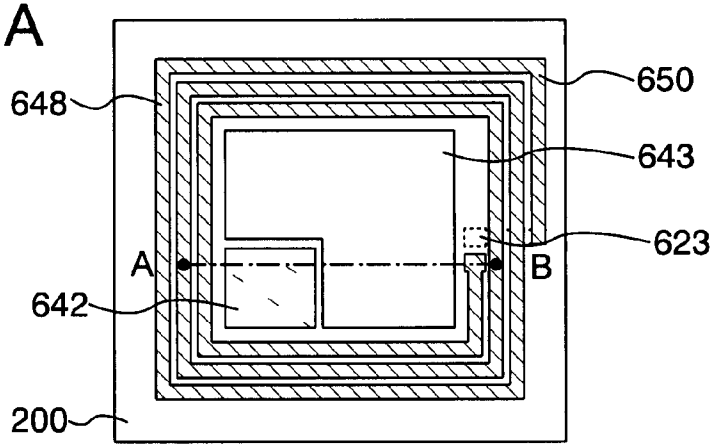
FIGS. 11A and 11B each show a plan view and a cross sectional view of a wireless chip of a block of the present invention.

In FIG. 11A, a top view of the wireless chip including a coil-shaped antenna is shown. The wireless chip 200 includes the memory area 642 and the integrated circuit region 643 in a central portion of the film substrate 650, and a coil-shaped antenna 648 is provided so as to surround them. The coil-shaped antenna is an antenna that is provided in a rectangular shape, and has 4 or more corners. Also, such an antenna is in a state in which it is coiled so that a diameter increases from the center towards the exterior.

Further, at an end of the antenna 648, the pad 623 for connecting to the resonance capacitor of the resonance circuit 201 may be provided. This is because data writing can be carried out without being affected by stress when thermocompressing the antenna.

This embodiment mode can be freely combined with other embodiment modes. For example, the wireless chip can be formed by transferring the thin film transistor from the insulating substrate to the film substrate 650.

Figure 11B:
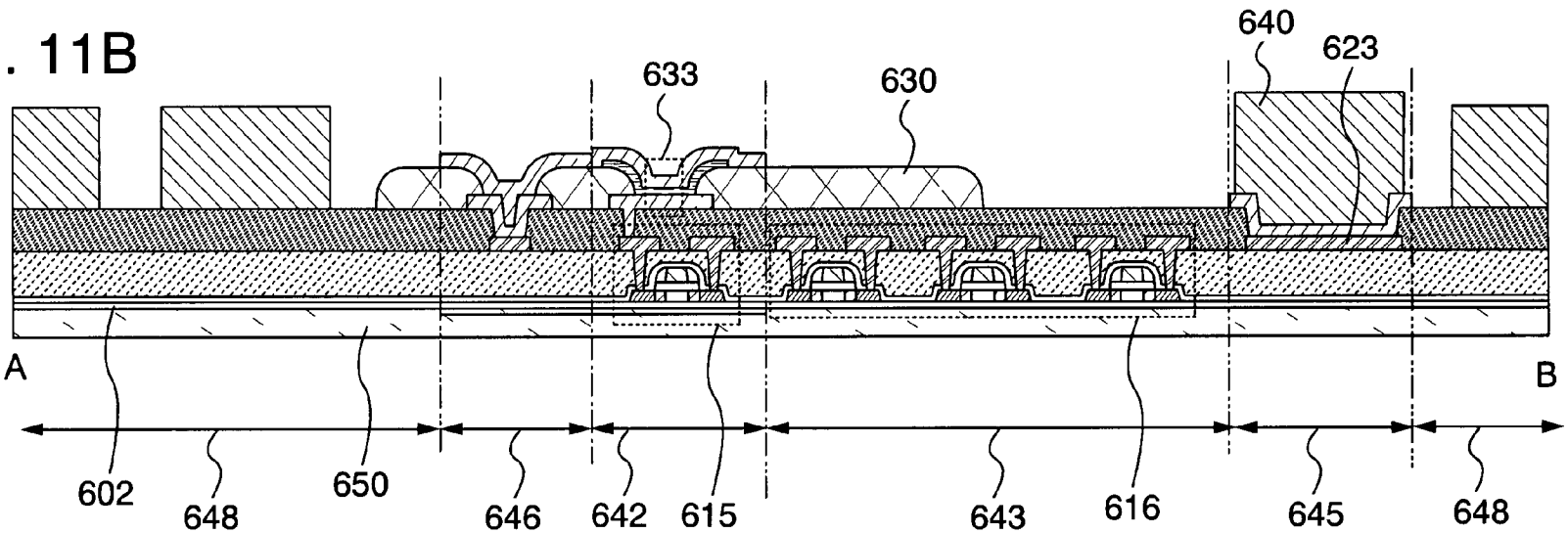

FIG. 11B shows a cross-sectional view of such a wireless chip along a line A-B. In the cross-sectional view along the line A-B, the wireless chip includes on each side an antenna 648, and the contact region 646, the memory area 642, the integrated circuit region 643, and the pad region 645 are provided in this order from one of the antennas 648.

Over the film substrate 650, the TFT 615, the TFT group 616, and the like are provided with the insulating layer 602 interposed therebetween in a similar manner to the foregoing embodiment mode. A memory element 633 is formed over the TFT 615, and the insulating layer 630 that segments the memory element 633 is provided over the memory area 642 and the integrated circuit region 643.

An open portion is provided in the insulating layer, the pad 623 is formed, and the antenna 640 is provided so as to be thermocompressed to the pad.

This application is based on Japanese Patent Application serial no. 2005-370271 filed in Japan Patent Office on Dec. 22, 2005, the entire contents of which are hereby incorporated by reference.

What is claimed is:

1. A toy block set comprising:

at least two toy blocks, and a container box for storing the two toy blocks, wherein:

each of the two toy blocks includes a wireless chip, each of the wireless chips including a memory which stores information, including an authentication number, and the container box includes a reader configured for obtaining the information of the wireless chip, an interface portion configured for communicating with a server via the Internet the information of the wireless chip and configured for receiving an assembly manual from the server via the Internet due to said information, a memory for storing the assembly manual, a display portion for displaying the assembly manual, and an ID acquisition button for acquiring the authentication number of the wireless chip.

2. The toy block set according to claim 1, wherein the wireless chip is attached to each of the two toy blocks.

3. The toy block set according to claim 1, wherein the wireless chip is provided inside of each of the two toy blocks.

4. The toy block set according to claim 1, wherein the wireless chip includes at least a thin film transistor.

5. The toy block set according to claim 1, wherein the wireless chip includes at least a thin film transistor over a film.

6. The toy block set according to claim 1, wherein the wireless chip has at least any one of a resonance circuit, a power source generation circuit, a clock generation circuit, a demodulation circuit, a reading circuit, an authentication register, an encoding circuit, and a modulation circuit.

7. The toy block set according to claim 1, wherein the wireless chip has a resonance circuit, and wherein the resonance circuit has an antenna and a resonance capacitor.

8. The toy block set according to claim 1, wherein the wireless chip has at least any one of a resonance circuit, a power source generation circuit, a clock generation circuit, a demodulation circuit, a reading circuit, an authentication register, an encoding circuit, and a modulation circuit, wherein the resonance circuit generates an AC signal from an electrical wave received from the container box, wherein the power source generation circuit generates power from the AC signal, wherein the clock generation circuit generates a clock signal from the AC signal, wherein the demodulation circuit demodulates the AC signal and transmits a demodulated data to the reading circuit, wherein the reading circuit transmits an authentication number reading instruction included in the demodulated data, wherein the authentication register transmits an authentication number of the wireless chip to the encoding circuit, according to the authentication number reading instruction, wherein the encoding circuit transmits an authentication signal which is the authentication number that is encoded, to the modulation circuit, and wherein the modulation circuit transmits a modulated data which is the authentication signal that is modulated, to the resonance circuit.

9. The toy block set according to claim 1, wherein the container box includes a control apparatus, and wherein the control apparatus includes a reader portion that can transmit/receive an authentication signal to/from the wireless chip.

10. The toy block set according to claim 1, wherein the container box includes a memory, and wherein the memory stores a program, an authentication number of the block, and the assembly manual.

11. The toy block set according to claim 1, wherein the container box includes a memory, and wherein the memory is a nonvolatile memory.

12. A managing method of a toy block set including at least two toy blocks and a container box, comprising the steps of:

pressing down an ID acquisition button of the container box to start obtaining information, including an ID acquisition number, of each wireless chip of the toy blocks, obtaining the information of each wireless chip of the toy blocks by a reader portion of the container box, communicating the information of each wireless chip and receiving assembly manual via the Internet due to said information by an interface portion of the container box, storing the assembly manual in a memory of a control apparatus, and displaying the assembly manual by a display portion of the container box, wherein the container box contains the display portion.

13. A managing method of a toy block set according to claim 12, further comprises:

generating an AC signal from an electrical wave received from the container box with a resonance circuit of the wireless chip, generating power from the AC signal with a power generation circuit of the wireless chip, generating a clock signal from the AC signal with a clock generation circuit of the wireless chip, demodulating the AC signal with a demodulation circuit of the wireless chip and transmitting a demodulated data to a reading circuit of the wireless chip, transmitting an authentication number reading instruction included in the demodulated data to a authentication register of the wireless chip with the reading circuit, transmitting an authentication number unique to the wireless chip to an encoding circuit with the authentication register, according to the authentication number reading instruction, transmitting an authentication signal which is the authentication number that is encoded, to a modulation circuit with the encoding circuit of the wireless chip, and transmitting a modulated data which is the authentication signal that is modulated, to the resonance circuit with the modulation circuit of the wireless chip.

14. A managing method of a toy block set containing a wireless chip, a container box and a display portion comprising the steps of:

pressing down an ID acquisition button of the container box to start obtaining information, including an ID acquisition number, of the wireless chip of a toy block, obtaining the information of the wireless chip of the toy block by a reader portion of the container box, communicating the information of the wireless chip and receiving a first assembly manual via the Internet due to said information by an interface portion of the container box, storing the first assembly manual in a memory of a control apparatus, displaying the first assembly manual by the display portion of the container box, receiving a second assembly manual via the Internet due to said information by the control apparatus, storing the second assembly manual in the memory of the control apparatus, and displaying the second assembly manual by the display portion.

15. A managing method of a toy block set according to claim 14, further comprises:

generating an AC signal from an electrical wave received from the container box with a resonance circuit of the wireless chip, generating power from the AC signal with a power generation circuit of the wireless chip, generating a clock signal from the AC signal with a clock generation circuit of the wireless chip, demodulating the AC signal with a demodulation circuit of the wireless chip and transmitting a demodulated data to a reading circuit of the wireless chip, transmitting an authentication number reading instruction included in the demodulated data to a authentication register of the wireless chip with the reading circuit, transmitting an authentication number unique to the wireless chip to an encoding circuit with the authentication register, according to the authentication number reading instruction, transmitting an authentication signal which is the authentication number that is encoded, to a modulation circuit with the encoding circuit of the wireless chip, and transmitting a modulated data which is the authentication signal that is modulated, to the resonance circuit with the modulation circuit of the wireless chip.

* * * * *